US008410384B2

(12) United States Patent
da Silva et al.

(10) Patent No.: US 8,410,384 B2
(45) Date of Patent: Apr. 2, 2013

(54) ACTUATING DEVICE

(75) Inventors: Manuel da Silva, Berg (DE); Ralf Siegler, Schlier (DE)

(73) Assignee: Rafi GmbH & Co., KG, Berg (DE)

( * ) Notice: Subject to any disclaimer, the term of this patent is extended or adjusted under 35 U.S.C. 154(b) by 299 days.

(21) Appl. No.: 12/800,415

(22) Filed: May 14, 2010

(65) Prior Publication Data

US 2010/0294637 A1 Nov. 25, 2010

(30) Foreign Application Priority Data

May 16, 2009 (DE) ..... 10 2009 021 667

(51) Int. Cl.
*H01H 13/04* (2006.01)

(52) U.S. Cl. ..... 200/333

(58) Field of Classification Search ..... 200/329, 200/333, 335, 343
See application file for complete search history.

(56) References Cited

U.S. PATENT DOCUMENTS 7,250,579 B2 * 7/2007 Ahlers et al. ..... 200/329
2005/0061647 A1 3/2005 Ichihara et al.

FOREIGN PATENT DOCUMENTS

DE 3405654 8/1985

* cited by examiner

*Primary Examiner* — Vanessa Girardi
(74) *Attorney, Agent, or Firm* — Pandiscio & Pandiscio

(57) ABSTRACT

An actuating device (1), generating an electrical switching signal, comprising a housing (2) and a cover (4) which is held in a groove (8) worked into the housing, and a switching contact (6) attached in the interior (21) of the housing (2), the switching contact (6) is moved from an initial position (a) to a switching position (b) by closure of the cover (4) either directly or by intermediate elements (19) attached to the cover (4), a reliable and positionally accurate closure of the cover (4) in order to generate a switching contact, even if the cover (4) has an off-center actuation force applied to it is achieved because at least one abutment (11) is attached facing the cover (4) on the base (23) of the housing, and has a support surface (17) corresponding to the movement of the cover (4) mounted in the groove (8), and at least one bearing element (12) is attached to the cover (4) which, when the cover (4) is in its assembled status, makes contact with the support surface (17) of the abutment (11) and is thus supported when the cover (4) is actuated.

11 Claims, 8 Drawing Sheets

ACTUATING DEVICE

Figure 1A:
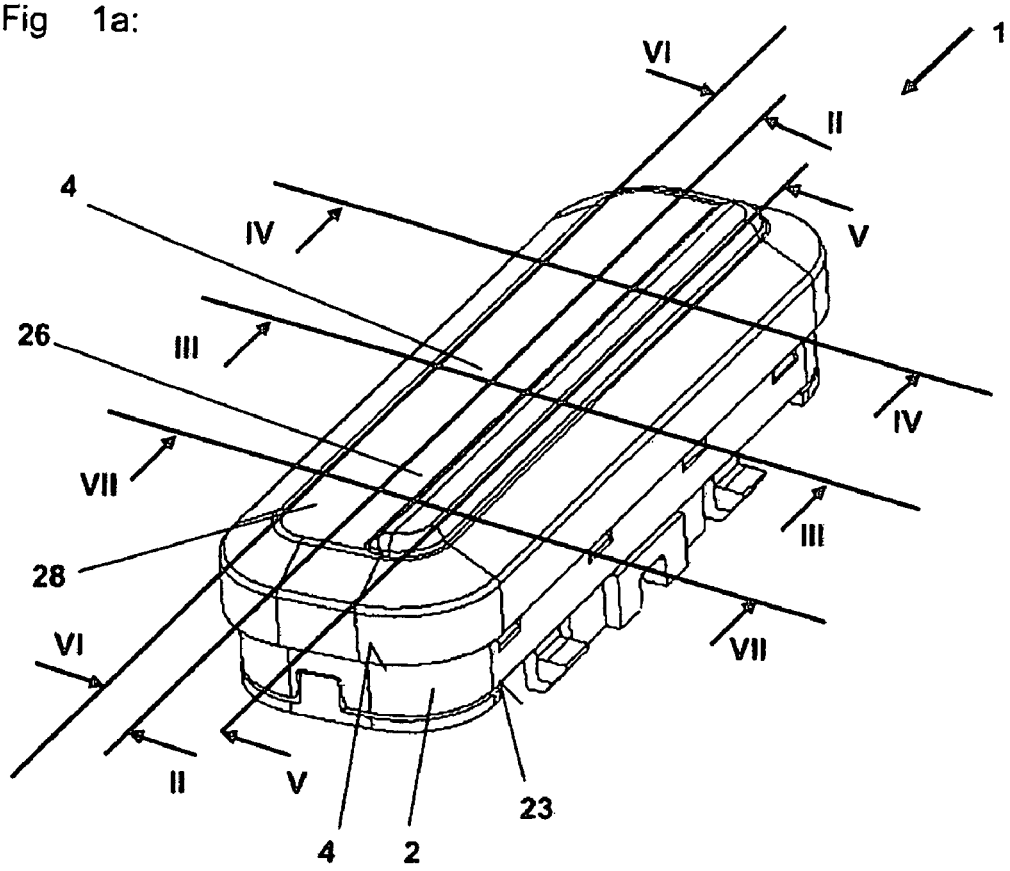

The invention relates to an actuating device for generating an electrical switching signal in accordance with the precharacterising clause of patent claim 1.

An actuating device of this kind is disclosed in EP 102 02 371 B4. This publication discloses a rear lid lock for motor vehicles; the handle flap to be actuated is mounted in a swiveling arrangement in a handle housing in this case. The handle flap has a return force acting on it which must be overcome in order to move the handle flap into a working position.

In this case, an electrical switch of prior art is provided as the switching contact, and this switch is activated by the handle flap. This means operating the handle flap enables the lock of a luggage compartment lid to be opened, because the switching contact enables an electrical signal to be generated which causes the lock of the luggage compartment lid to be released.

DE 34 47 085 A1 discloses a momentary contact switch with an elastic diaphragm key which provides for reliable closing of the contacts with low inherent resistance.

It has proven to be disadvantageous with the disclosed state of the art that the actuation of the cover does not function reliably, namely if the actuation force acting on the cover is exerted off-centre in relation to the cover. Force application of this kind namely results in the cover being actuated at an angle to the plane of the horizontal, resulting in the situation in which the cover can be canted when being pressed down into the housing.

Furthermore, the deflection of the cover in relation to the switching contact, and in particular in relation to the switch surface of the switching contact, is impaired, with the effect that when the cover is deflected at a corresponding angle then the contacting between the cover and the switching contact is prevented.

It is therefore a task of the present invention to develop the actuating device of the aforementioned kind such that a reliable and positionally accurate closure of the cover is guaranteed at all times in order to generate a switching contact, including when the cover has an off-centre actuation force applied to it.

This purpose is achieved by the features that are listed in the characterising clause of patent claim 1.

Other advantageous further embodiments of the invention are disclosed in the subordinate claims.

One or more abutments is/are attached on the base of the housing that is/are facing the cover, therefore the swiveling movement of the cover can be supported because the support surface formed onto the abutment has contours which correspond to this swiveling movement. As a result, when the cover is being pressed down not only is it supported by the axis of rotation that is formed by the groove and the bead attached to the cover, but also the abutment and the bearing bodies absorb the torques and forces that arise.

These actuation forces are supported irrespective of the point of action at which the actuation forces are applied to the cover. Accordingly, two bearing pairs formed by the abutment and the bearing body located with a gap in between them ensure a practically even swiveling movement of the cover, with the effect that the cover can act on the switching contact directly or by means of a tappet formed as an intermediate element, and that the cover can act in this way irrespective of the point of action at which the actuation force is applied to the cover, thus deflecting it.

Figure 1B:
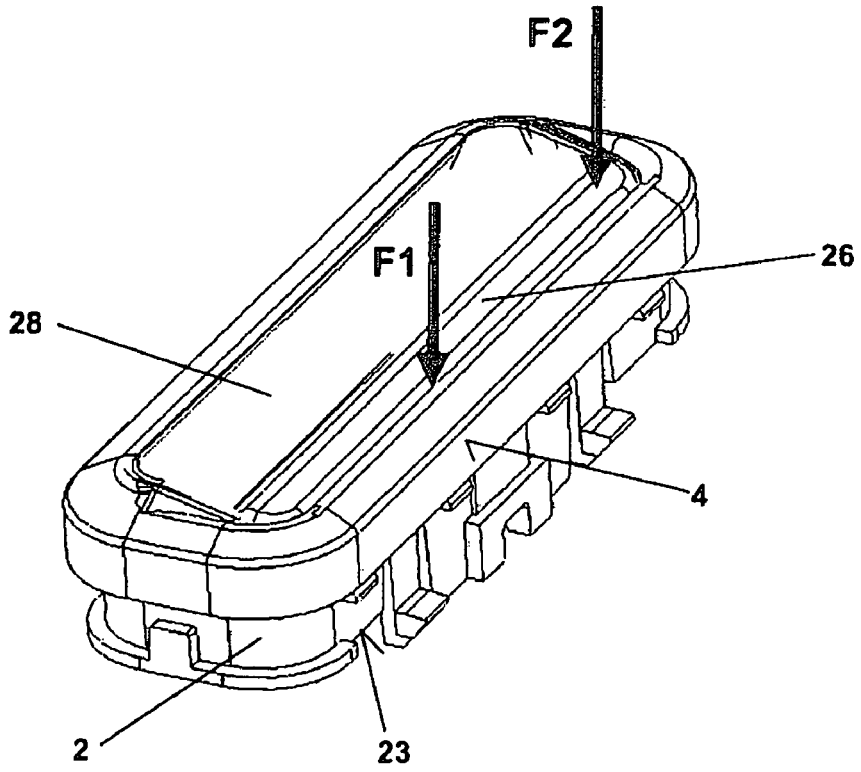
Figure 2A:
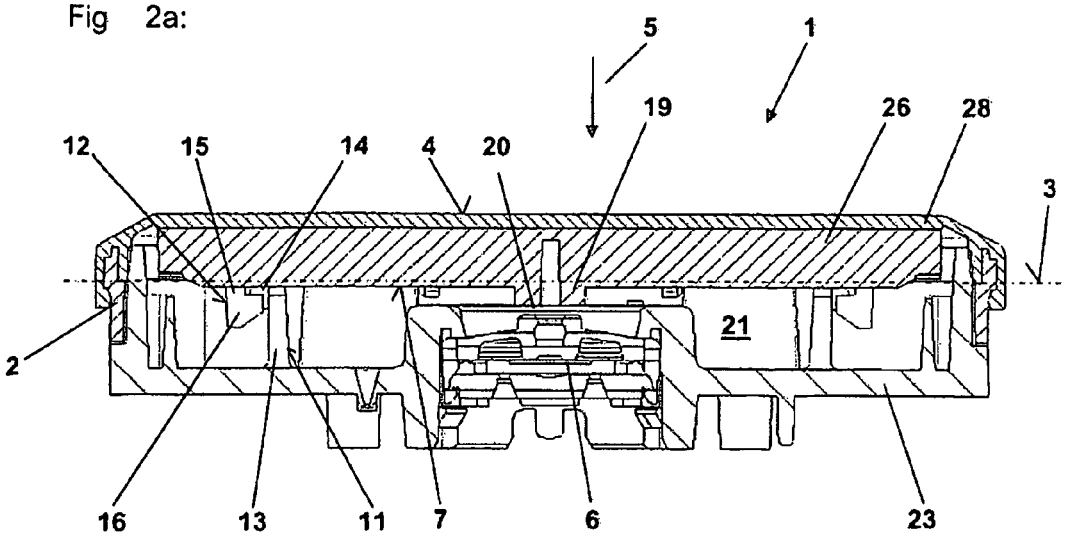
Figure 2B:
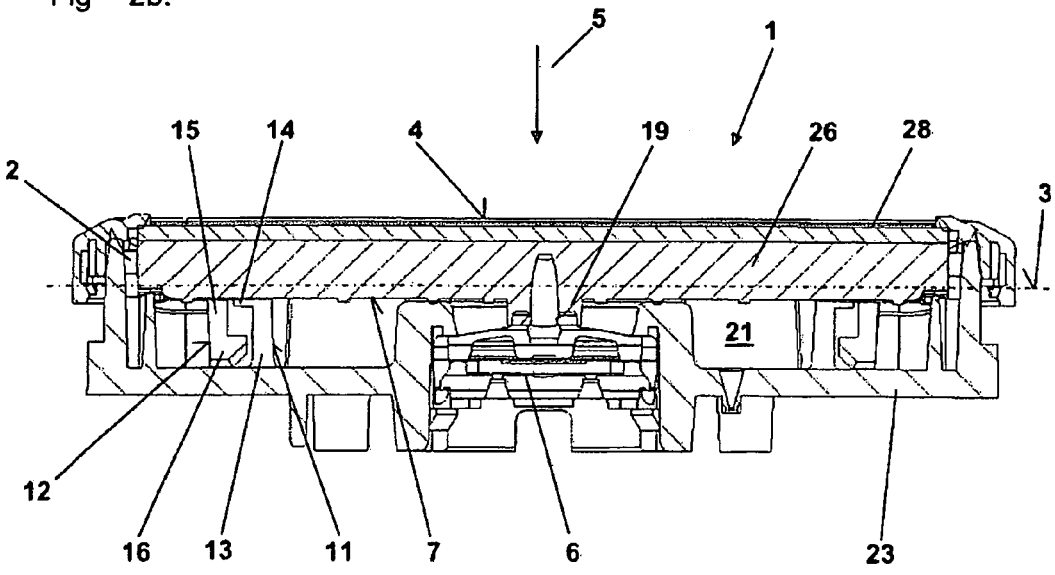

The drawing shows a sample embodiment of an actuating device configured in accordance with the present invention, the details of which are explained below. In detail, the figures identified with "a" show the non-actuated status of the actuating device and the figures identified with "b" show the actuated status:

FIG. 1*a* shows the actuating device with a housing in which a cover is inserted, in a perspective view, FIG. 1*b* shows the actuating device with two actuation forces acting on the cover;

FIGS. 2*a* and 2*b* show the actuating device along the section II-II in accordance with FIG. 1*a;*

Figure 3A:
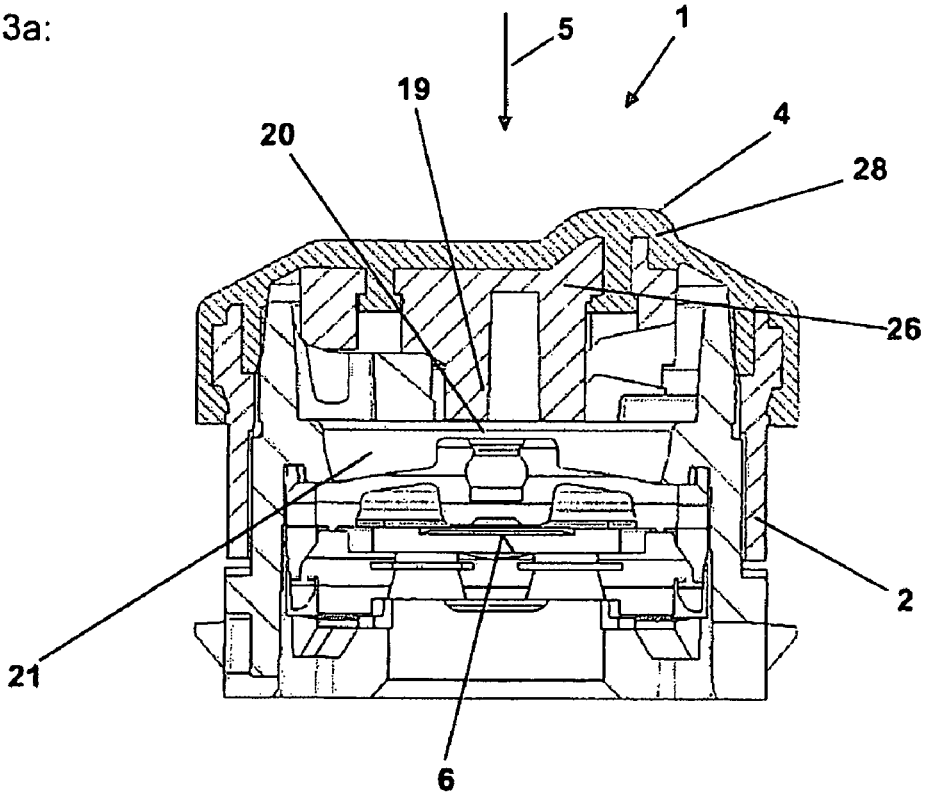
Figure 3B:
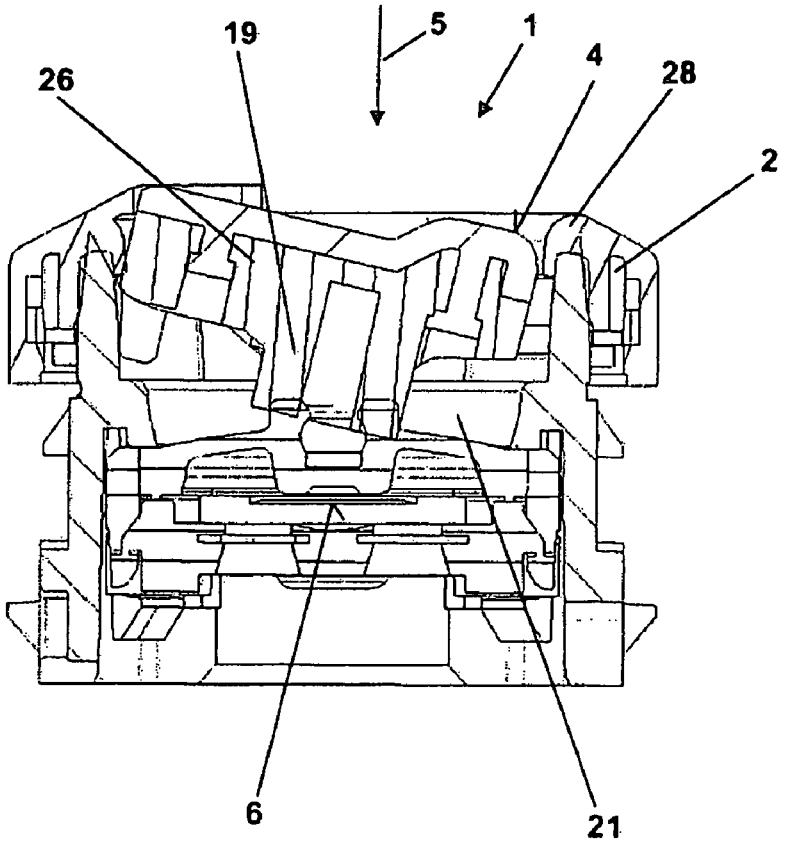

FIGS. 3*a* and 3*b* show the actuating device along the section III-III in accordance with FIG. 1*a;*

Figure 4A:
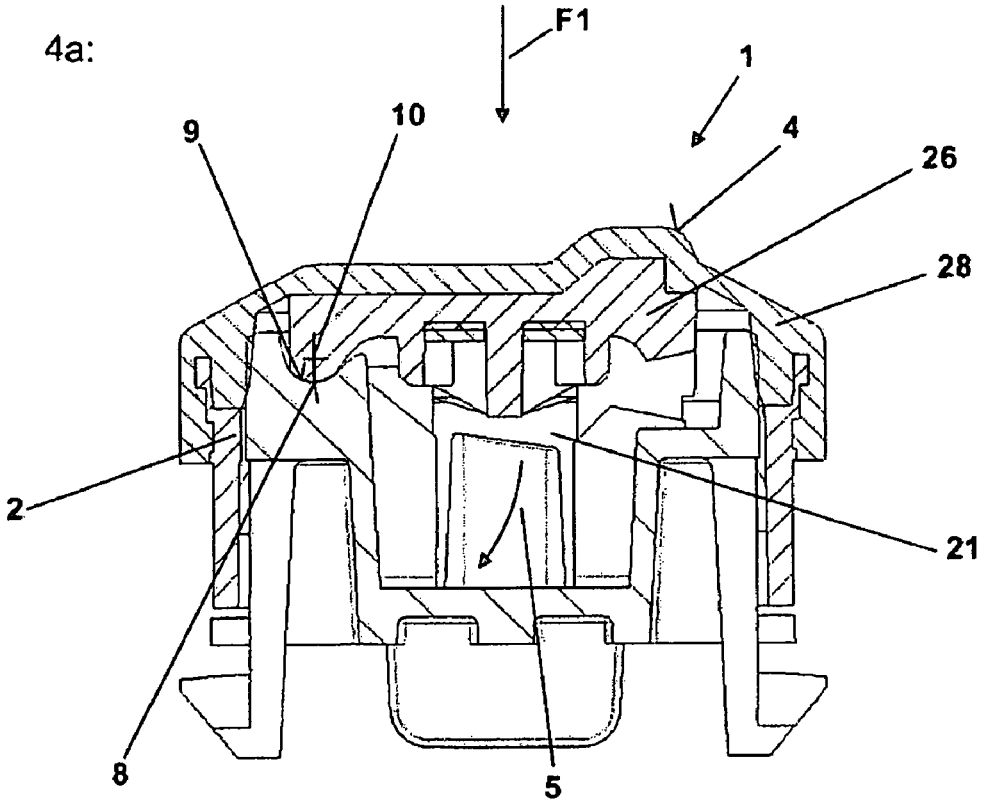
Figure 4B:
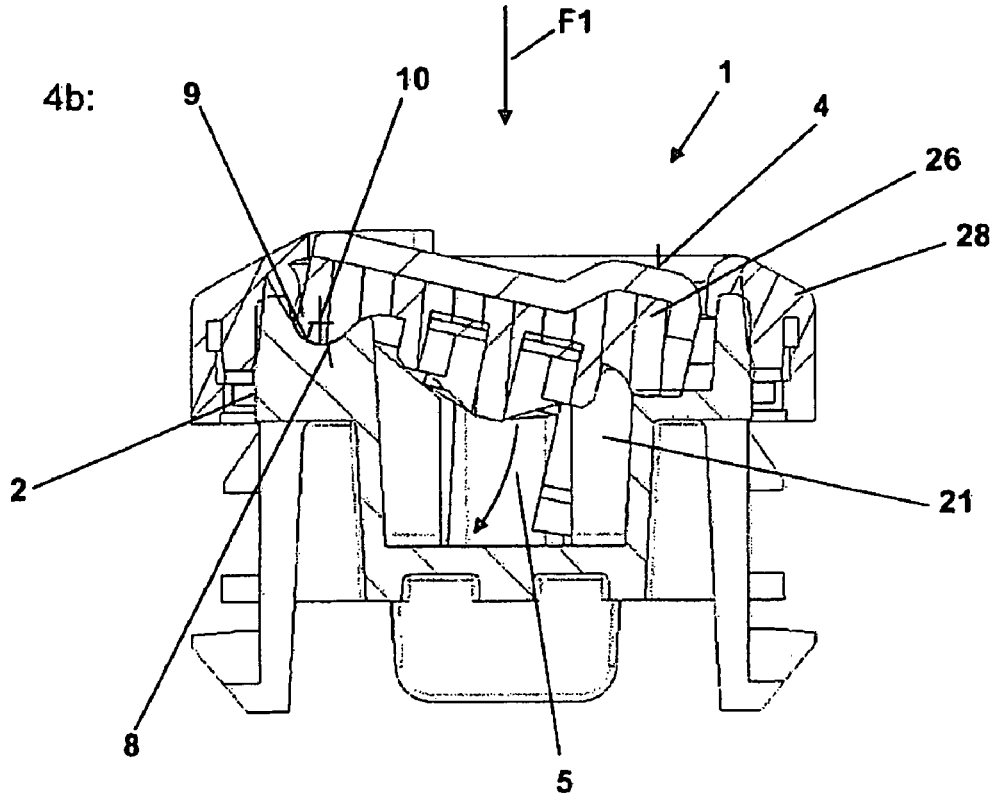

FIGS. 4*a* and 4*b* show the actuating device along the section IV-IV in accordance with FIG. 1*a;*

Figure 5A:
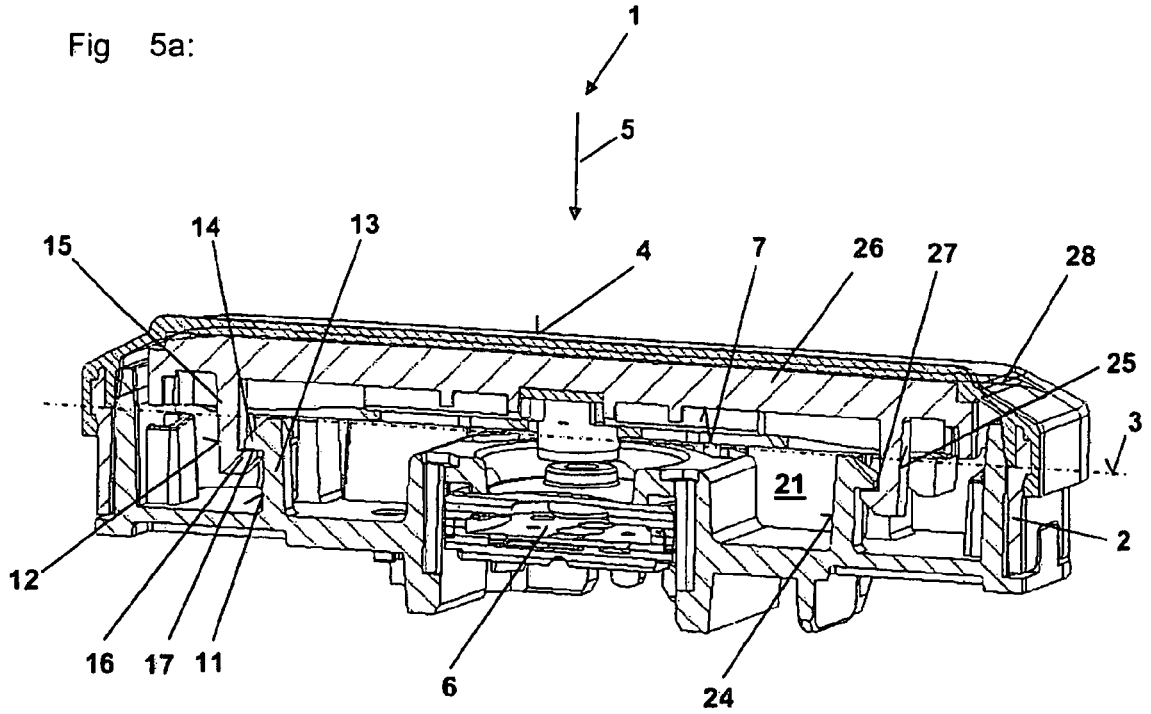
Figure 5B:
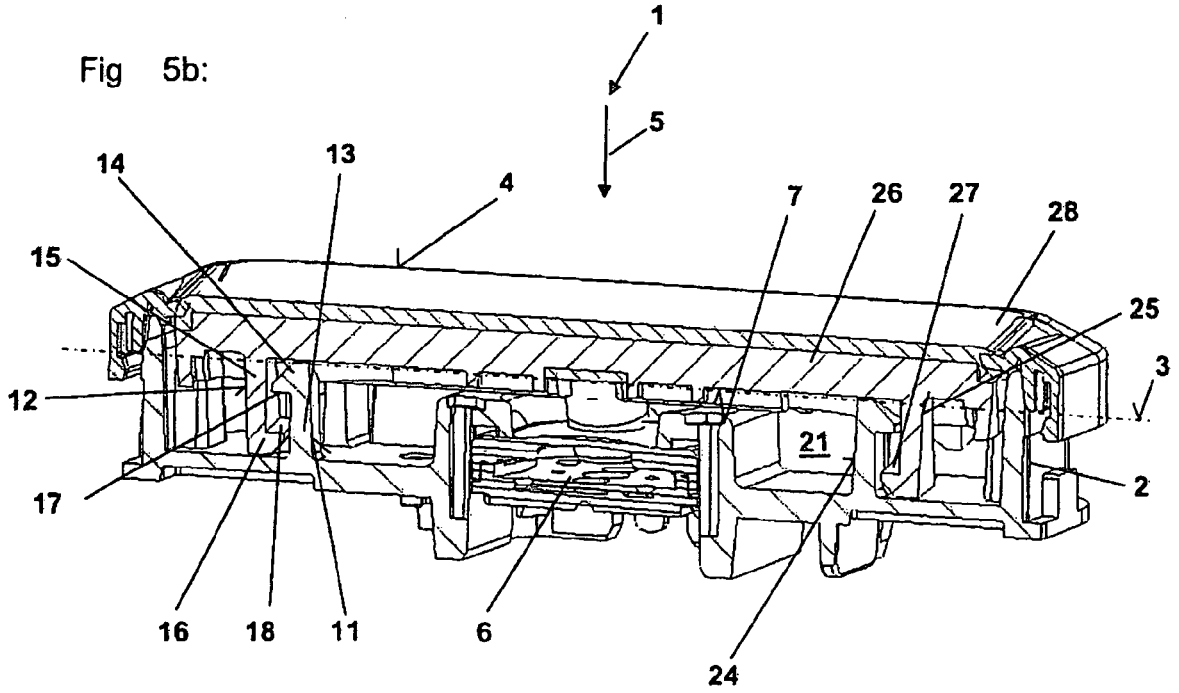

FIGS. 5*a* and 5*b* show the actuating device along the section V-V in accordance with FIG. 1*a;*

Figure 6A:
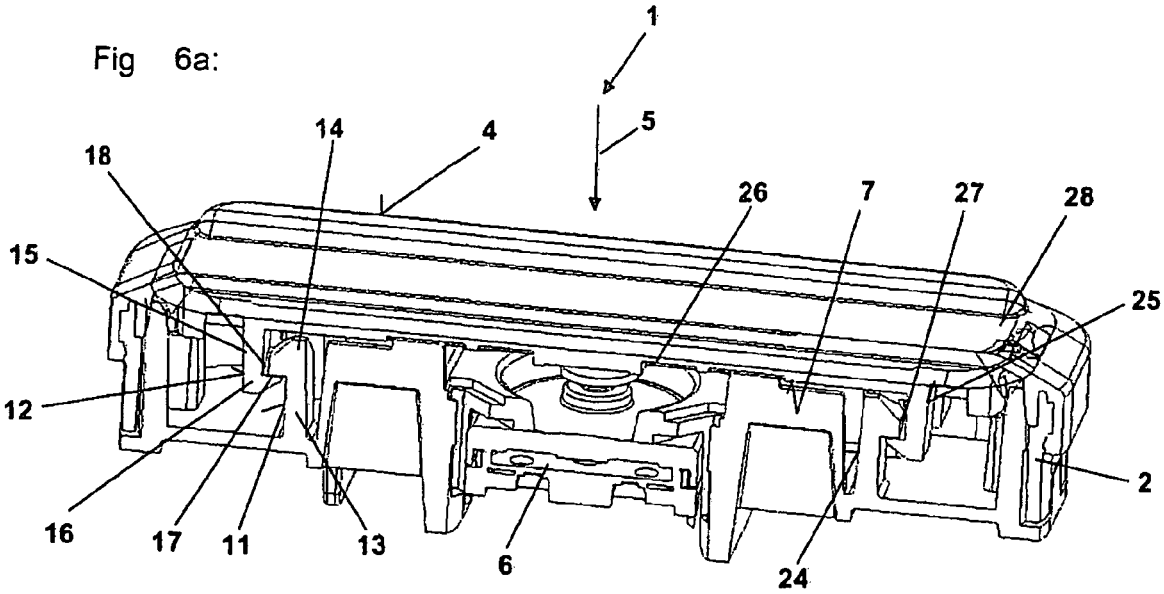
Figure 6A:
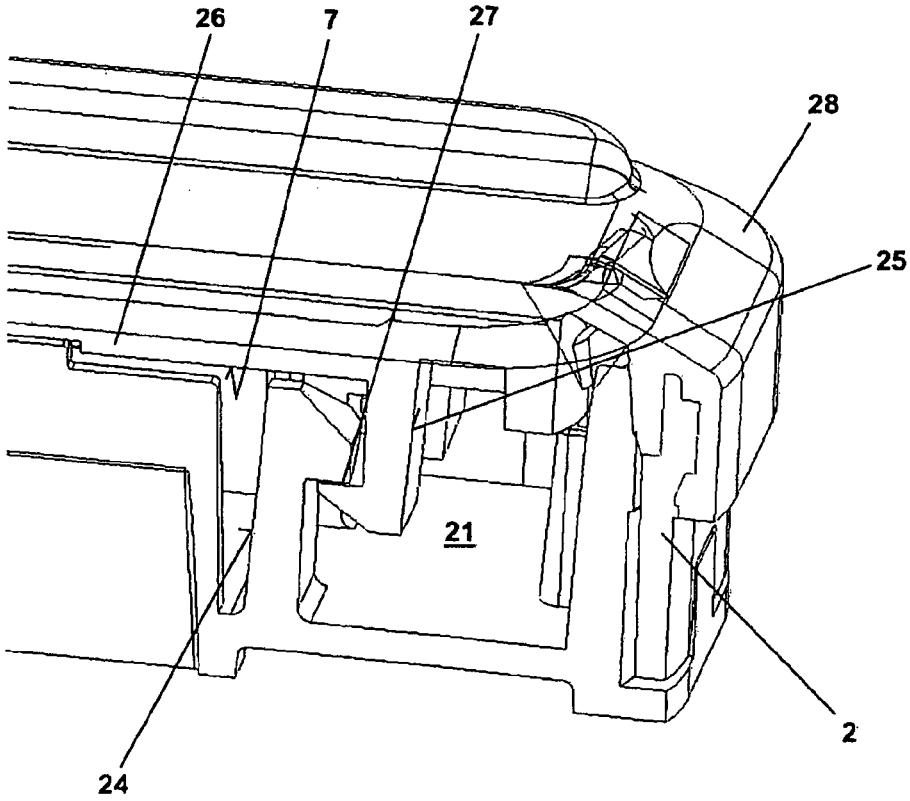
Figure 6B:
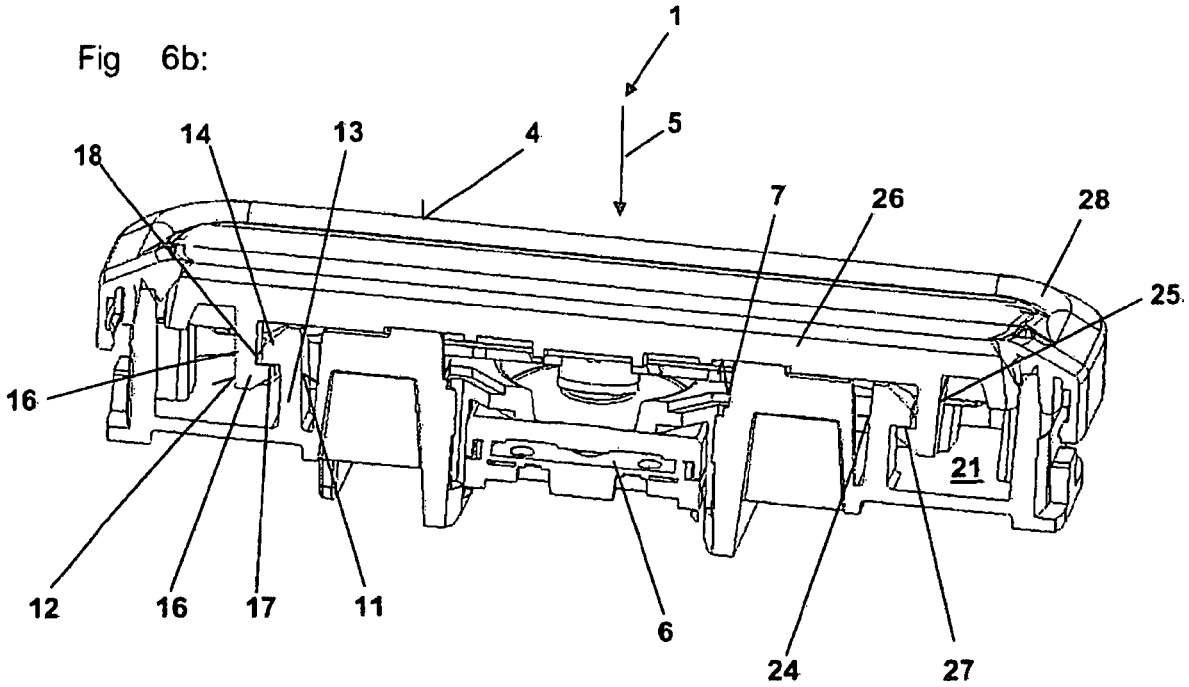
Figure 6B:
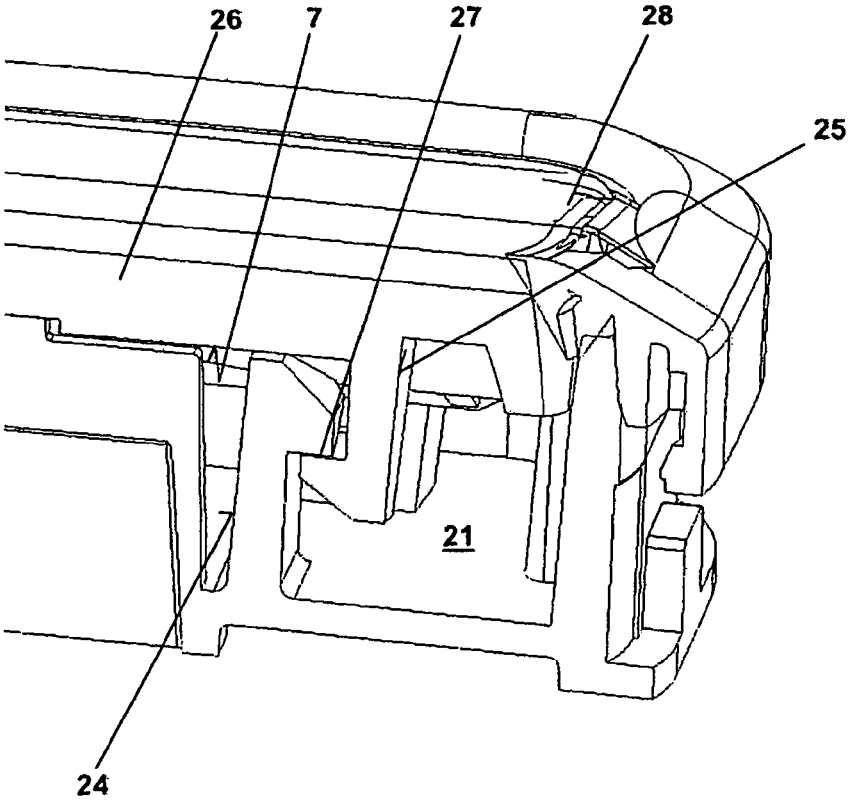
Figure 7A:
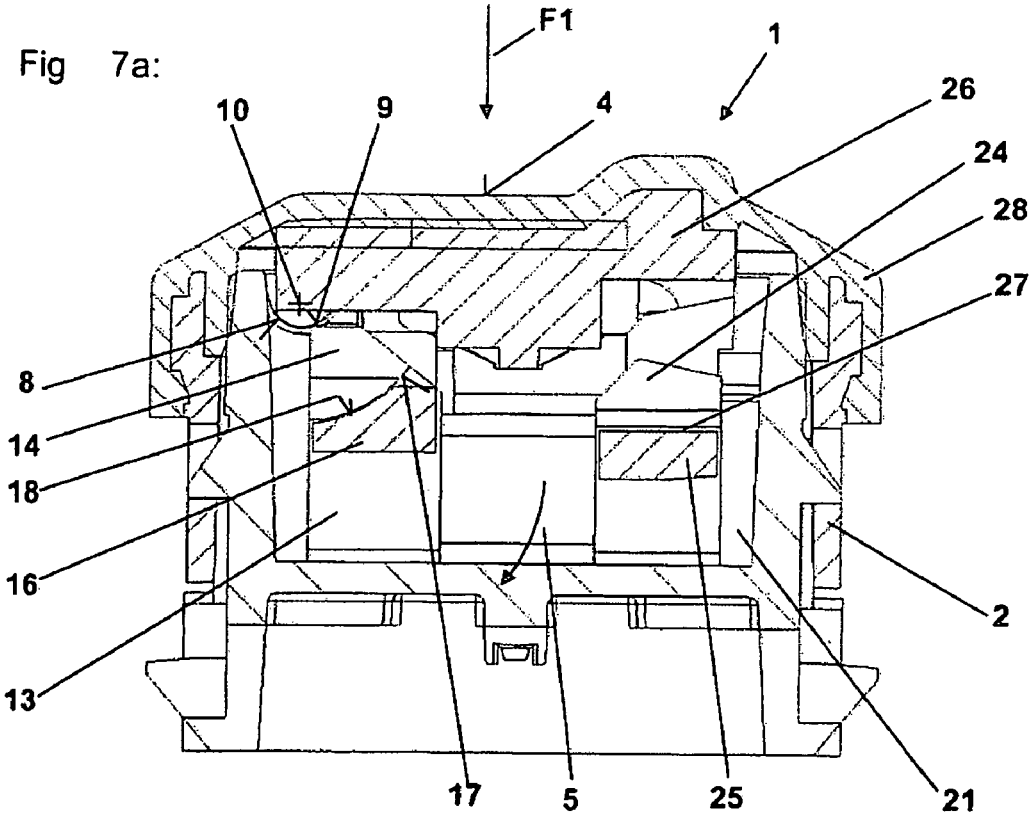
Figure 7B:
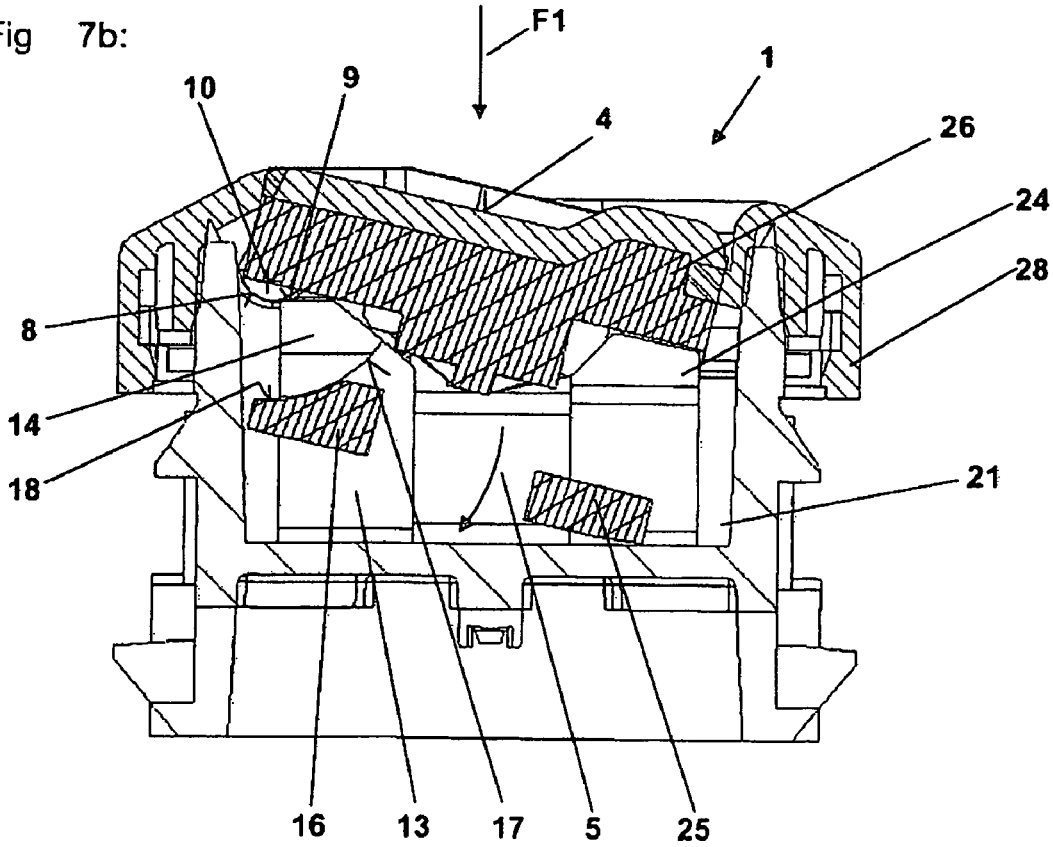

FIGS. 6*a* and 6*b* show the actuating device along the section VI-VI in a magnified view and FIGS. 7*a* and 7*b* show the actuating device along the section VII-VII in accordance with FIG. 1*a.*

FIGS. 1*a* and 1*b* show an actuating device 1 which is attached, for example, to a luggage compartment lid of a vehicle and has a housing 2 that is configured as a box section. The two ends of the housing 2 are closed by a base 23 and by a cover 4 at the opposite end. The cover 4 is manufactured in a two-component injection moulding process, in such a way that the cover 4 consists of a flexible or elastically deformable edge part 28 and of a flexurally rigid plate 26 that are jointly snapped onto the housing 2 or are held onto it, for example by means of adhesive. The edge part 28 is consequently configured as an elastically deformable plastic mat. The plate 26 is accessible from the outside and can therefore be actuated against the return force of the plastic mat 28.

When the plate 26 is moved in the direction of a switching contact 6 arranged in the interior 21 of the housing 2, as is explained in more detail below, then the switching contact 6 is activated with the effect that it generates an electrical switching signal by means of which the lock of the luggage compartment lid of the vehicle is released. An actuating device 1 of this kind can also be used for any other application areas.

FIG. 1*b* in particular shows that an actuation force $F_1$ or $F_2$ acts on the plastic mat 28 and thereby on the plate 26. The plate 26 is therefore moved out of an initial position a into a switching position b. The mounting of the plate 26 on the housing described below means that the plate 26 is reliably moved in the direction of the switching contact 6 in order to activate it, irrespective of whether the actuation force is applied precisely in the centre or is off-centre in relation to the plate 26.

FIGS. 2*a* to 7*b* show the design structure and therefore the mounting arrangement of the plate 26 on the housing 2.

Two abutments 11 are formed on the base 23 of the housing 2 which are flush with one another and spaced apart, and consists of two webs 13 and 14. The first web 13 in this case projects at right angles from the base 23 and consequently projects into the interior 21 of the housing 2. The second web 14 runs at right angles to the first web 13, in other words it is parallel with the cover 4, and it has a convex shaped support surface 17 corresponding to the swiveling movement of the plate 26 or the cover 4.

In FIGS. 4*a* and 4*b* in particular, it is possible to see that a groove 8 with a semicircular cross section is formed into the end of the housing 2 facing towards the cover 4. The plate 26 of the cover 4 has a bead 9 provided on it, which also has a semicircular cross-sectional area. The outer contour of the bead 9 is adapted to the inner contour of the groove 8. The groove 8 and the bead 9 therefore form an axis of rotation 10 that runs in parallel with the lengthways axis 3 of the housing 2.

The plate 26 swivels about the axis of rotation 10 that is formed in this way, with the effect that it can be moved towards the switching contact 6 that is attached to the base 23. The swiveling movement of the plate 26 in this case is identified in FIGS. 4*a* and 4*b* with the reference number 5, thereby schematically indicating the actuation direction. There is an air gap 20 provided in between the underside of the cover 4 facing the switching contact 6 and this, with the effect that the switching contact 6 does not apply any forces to the cover 4 or the plate 26 in the initial position a and the switching contact 6 does not apply any return force to the cover 4 at least from a specific position of the plate 26 onwards.

FIGS. 5*a*, 5*b* and 7*a*, 7*b* in particular show the design arrangement of the mounting of the cover 4. Two bearing bodies 12 spaced apart and running parallel to the lengthways axis 3 are attached on the inside 7 of the cover 4 facing the base 23, and consist of two legs 15 and 16 arranged at right angles to one another. The first leg 15 is attached to the inside 7 of the cover 4 and the second leg 16 projects at right angles from the first leg 15 in the direction of the corresponding abutment 11. In their positioning, the abutment 11 and the bearing bodies 12 correspond to one another in the assembled status, because the second web 14 of the abutment 11 and the support surface 17 of the abutment 11 facing the bearing body 12 enclose—at least over a certain area—the second leg 16 of the bearing body 12. The contact surface 18 of the second leg 16 in this case has a convex configuration and is adapted to the inner contour of the support surface 17 of the second web 14 of the abutment 11, which has a concave curvature.

If, consequently, the plate 26 is pressed in the direction of the switching contact 6 then the plate 26 is swivelled about the axis of rotation 10 and additionally held by the support surface 17. Irrespective of the position at which the actuation force acts on the plate 26, it is evenly moved in the direction of the switching contact 6 because any canting or misalignment of the plate 26 in relation to the housing 2 is prevented by the mounting arrangement between the abutment 11 and the bearing body 12.

The abutments 11 and the bearing bodies 12 are located with a lateral offset in relation to the axis of rotation 10, in order to absorb the torques and forces that arise. The length of the groove 8 and of the bead 9 is limited to a portion of the length of the housing 2. The abutments 11 and the bearing bodies 12 are arranged in the interior 7 of the housing 2 as an extension of the groove 8 and of the bead 9.

The plate 26 is moved back into its initial position a by the elastically deformable plastic mat 28 as soon as the actuation force $F_1$ or $F_2$ ceases to act on the plate 26. In order to prevent the plastic mat 28 pushing the plate 26 out of the housing 2, i.e. beyond its initial position a, there are two detent hooks 24 provided on the cover 4 which project at right angles from the cover 4 into the interior 21 of the housing 2. In order to hold and support the corresponding detent hook 24, two detent hooks 25 are attached projecting from the base 23 in the direction of the cover 4. The two detent hooks 24 and 25 therefore form a pair of detent hooks between which a stop surface 27 is provided. Each of the detent hooks 24 and 25 has an L-shaped cross section, with the effect that the detent hooks 24 and 25 form a locking mechanism or undercut which prevents the plate 26 from coming loose from the housing 2.

The detent hooks 24 and 25 are arranged flush with the corresponding abutment 11 and the bearing body 12; the abutments 11, bearing bodies 12 and detent hooks 24 and 25 arranged on the same axis run at right angles to the lengthways axis 3 of the housing 2.

A tappet 19 as an intermediate element is attached to the inside of the plate 26 facing towards the switching contact 6, with the free end of the tappet 19 not in contact with the switching contact 6 in the initial position a, because the air gap 20 is provided between them.

What is claimed is:

1. An actuating device (1) for generating an electrical switching signal, the device comprising a housing (2), a cover (4) accessible from outside said housing and attached to said housing, and held in a swiveling arrangement in a groove (8) in said housing (2), and a switching contact (6) attached in an interior (21) of said housing (2), and moveable from an initial position into a switching position by closure of said cover (4);

and abutment means (11) facing towards said cover (4) is/are attached to a base (23) of said housing (2), and is provided with a support surface (17) corresponding to swiveling movement of said cover (4) mounted in the groove (8), and one or more bearing bodies (12) is/are attached to said cover (4) which, when said cover (4) is mounted, each make contact with one of the support surfaces (17) of said abutment means (11) and are thereby supported when said cover (4) is actuated;

wherein said abutment means (11) comprise first and second webs (13, 14) arranged at right angles to one another;

wherein said first web (13) projects at right angles from the base (23) of said housing (2) into the interior (21);

wherein the support surface (17) for holding a bearing body (12) attached to said cover is disposed on a second web and the support surface (17), and runs at right angles to a lengthways axis (3) of said housing (2); and wherein a cross-sectional surface of the groove (8) is semicircular in shape, and a bead (9) with a semicircular cross section is disposed on said cover (4), and is adapted to the inner contour of the groove (8), and is inserted into the groove (8) in an assembled condition; and the groove (8) and said bead (9) form a common axis of rotation (10) which extends parallel to the lengthways axis (3) of said housing (2).

2. The actuating device in accordance with claim 1, wherein an air gap (20) is provided between said cover (4) and said switching contact (6).

3. An actuating device (1) for generating an electrical switching signal, the device comprising a housing (2), a cover (4) accessible from outside said housing and attached to said housing, and held in a swiveling arrangement in a groove (8) in said housing (2), and a switching contact (6) attached in an interior (21) of said housing (2), and moveable from an initial position into a switching position by closure of said cover (4), and wherein an abutment means (11) facing towards said cover (4) is/are attached to a base (23) of said housing (2), and is provided with a support surface (17) corresponding to swiveling movement of said cover (4) mounted in the groove (8), and one or more bearing bodies (12) is/are attached to said cover (4) which, when said cover (4) is mounted, each make contact with one of the support surfaces (17) of said abutment means (11) and are thereby supported when said cover (4) is actuated; and wherein said abutment means (11) comprise first and second webs (13, 14) arranged at right angles to one another, wherein said first web (13) projects at right angles from the base (23) of said housing (2) into the interior (21); wherein the support surface (17) for holding a bearing body (12) attached to said cover is disposed on a second web and the support surface (17), and runs at right angles to a lengthways axis (3) of said housing (2); and wherein the bearing body (12) comprises two legs (15, 16) arranged at right angles to one another, wherein said first leg (15) projects into the interior (21) of said housing (2) at right angles from the inside (7) of said cover (4) facing the base (23), and said second leg (16) of the bearing body (12) is enclosed by said second web (14) of said abutment means (11) in the form of an undercut and is supported in a direction of the base (23) of said housing (2); and wherein the support surface (17) of said second leg (16) of said abutment means (11) is convex, and a contact surface (18) of said second leg (16) of the bearing body (12) facing the support surface (17) is provided with a concave profile corresponding to the convex profile.

4. The actuating device in accordance with claim 3, wherein said abutment means (11) and the bearing body (12) are arranged flush with, or at a lateral offset from, an axis of rotation (10) formed by the groove (8) and a bead (9).

5. The actuating device in accordance with claim 3, wherein at least one detent hook (24, 25) protruding into the interior (21) of said housing (2) is attached to the base (23) of said housing (2) and on the inside (7) of said cover (4) facing the base (23), the detent hooks (24, 25) being arranged flush with one another and, jointly, form a pair of detent hooks of an undercut type.

6. The actuating device in accordance with claim 5, wherein each one of the detent hook pairs is arranged flush with one of the pairs of the abutment means (11) and the bearing bodies (12).

7. The actuating device in accordance with claim 5, wherein the undercut of the detent hook pairs limits movement of said cover (4) opposite to its actuation direction (5) out of an initial position.

8. The actuating device in accordance with claim 7, wherein each of the detent hook pairs forms a stop surface (27) that extends in an area of a plane formed by the support surface (17) of the abutment (11).

9. An actuating device (1) for generating an electrical switching signal, the device comprising a housing (2), a cover (4) accessible from outside said housing and attached to said housing, and held in a swiveling arrangement in a groove (8) in said housing (2), and a switching contact (6) attached in an interior (21) of said housing (2), and moveable from an initial position into a switching position by closure of said cover (4); and wherein abutment means (11) facing towards said cover (4) is/are attached to a base (23) of said housing (2), and is/are provided with a support surface (17) corresponding to swiveling movement of said cover (4) mounted in the groove (8), and one or more bearing bodies (12) is/are attached to said cover (4) which, when said cover (4) is mounted, each make contact with one of the support surfaces (17) of said abutment means (11) and are thereby supported when said cover (4) is actuated;

wherein said cover (4) is of plastic and comprises a flexurally rigid plate (26) arranged in the middle of a flexible edge part (28) formed as an elastically deformable plastic mat and held against the plate (26) so as to allow for limited movement.

10. An actuating device (1) for generating an electrical switching signal, the device comprising a housing (2), a cover (4) accessible from outside said housing and attached to said housing, and held in a swiveling arrangement in a groove (8) in said housing (2), and a switching contact (6) attached in an interior (21) of said housing (2), and moveable from an initial position into a switching position by closure of said cover (4);

wherein abutment means (11) facing towards said cover (4) is/are attached to a base (23) of said housing (2), and is/are provided with a support surface (17) corresponding to swiveling movement of said cover (4) mounted in the groove (8), and one or more bearing bodies (12) is/are attached to said cover (4) which, when said cover (4) is mounted, each make contact with one of the support surfaces (17) of said abutment means (11) and are thereby supported when said cover (4) is actuated;

wherein said abutment means (11) comprise first and second webs (13, 14) arranged at right angles to one another;

wherein said first web (13) projects at right angles from the base (23) of said housing (2) into the interior (21), wherein the support surface (17) for holding a bearing body (12) attached to said cover is disposed on a second web and the support surface (17), and runs at right angles to a lengthways axis (3) of said housing (2);

wherein said bearing body (12) comprises two legs (15, 16) arranged at right angles to one another, wherein said first leg (15) projects into the interior (21) of said housing (2) at right angles from the inside (7) of said cover (4) facing the base (23), and said second leg (16) of the bearing body (12) is enclosed by said second web (14) of said abutment means (11) in the form of an undercut and is supported in a direction of the base (23) of said housing (2); and wherein a tappet formed as an intermediate element is disposed on the inside (7) of said cover (4) facing said switching contact (6), and an airgap (20) is disposed between the free end of the tappet and the switching contact.

11. An actuating device (1) for generating an electrical switching signal, the device comprising a housing (2), a cover (4) accessible from outside said housing and attached to said housing, and held in a swiveling arrangement in a groove (8) in said housing (2), and a switching contact (6) attached in an interior (21) of said housing (2), and moveable from an initial position into a switching position by closure of said cover (4); and wherein abutment means (11) facing towards said cover (4) is/are attached to a base (23) of said housing (2), and is/are provided with a support surface (17) corresponding to swiveling movement of said cover (4) mounted in the groove (8), and one or more bearing bodies (12) is/are attached to said cover (4) which, when said cover (4) is mounted, each make contact with one of the support surfaces (17) of said abutment means (11) and are thereby supported when said cover (4) is actuated; and wherein said abutment means (11) comprise first and second webs (13, 14) arranged at right angles to one another, wherein said first web (13) projects at right angles from the base (23) of said housing (2) into the interior (21), wherein the support surface (17) for holding a bearing body (12) attached to said cover is disposed on a second web and the support surface (17), and runs at right angles to a lengthways axis (3) of said housing (2); and wherein the bearing body (12) comprises two legs (15, 16) arranged at right angles to one another, wherein said first leg (15) projects into the interior (21) of said housing (2) at right angles from the inside (7) of said cover (4) facing the base (23), and said second leg (16) of the bearing body (12) is enclosed by said second web (14) of said abutment means (11) in the form of an undercut and is supported in the direction of the base (23) of said housing (2); and wherein at least one detent hook (24, 25) protruding into the interior (21) of said housing (2) is attached to the base (23) of said housing (2) and on the inside (7) of said cover (4) facing the base (23), the detent hooks (24, 25) being arranged flush with one another and, jointly, forming a pair of detent hooks of an undercut type; and wherein each of the detent hook pairs is at a distance from, and laterally offset from, the groove (8).

* * * * *